United States Patent [19]

Sire

[11] Patent Number: 4,886,518

[45] Date of Patent: Dec. 12, 1989

[54] DYEING CELLULOSE FIBRES WITHOUT INCURRING ENDING WITH COLORLESS PYRIMIDINE, TRIAZINE, AROMATIC, FURFURYL OR QUINOLINYL COMPOUND

[75] Inventor: Jean-Marie Sire, Hegenheim, France

[73] Assignee: Ciba-Geigy Corporation, Ardsley, N.Y.

[21] Appl. No.: 245,488

[22] Filed: Sep. 19, 1988

[30] Foreign Application Priority Data

Oct. 1, 1987 [CH] Switzerland ..... 3823/87

[51] Int. Cl.[4] ..... D06P 1/62; D06P 3/68

[52] U.S. Cl. ..... 8/566; 8/532; 8/567; 8/569; 8/585; 8/586; 8/590; 8/602; 8/605; 8/650; 8/651; 8/652; 8/666; 8/918

[58] Field of Search ..... 8/566, 567, 605, 585, 8/586, 590, 650

[56] References Cited

U.S. PATENT DOCUMENTS

| | | | |
|---|---|---|---|
| 2,298,533 | 10/1942 | Hentrich et al. | 252/DIG. 7 |
| 2,928,711 | 3/1960 | Denyer et al. | 8/541 |
| 2,940,814 | 6/1960 | Taras | 8/567 |
| 3,400,121 | 9/1968 | Weckler et al. | 8/541 |
| 4,246,670 | 1/1981 | Perrin et al. | 8/566 |
| 4,300,903 | 11/1981 | Engelhardt et al. | 8/531 |
| 4,313,732 | 2/1982 | Teague et al. | 8/541 |
| 4,504,272 | 3/1985 | Ong | 8/543 |
| 4,519,805 | 5/1985 | Koci | 8/610 |

FOREIGN PATENT DOCUMENTS

| | | |
|---|---|---|
| 242324 | 10/1987 | European Pat. Off. . |
| 71-004349 | 2/1971 | Japan . |

*Primary Examiner*—A. Lionel Clingman
*Attorney, Agent, or Firm*—Edward McC. Roberts

[57] ABSTRACT

A process for dyeing cellulose fibres or cellulose-containing blend fibres with vat dyes, sulfur dyes, leuco vat ester dyes or azoic dyes by the pad dyeing process without incurring ending, in which an aqueous dyeing liquor is used which, aside from the dye, contains a colorless compound of the formula (1)

or of the formula $$[R_1—NH—A—R_2]_{-}Z_m \quad (2)$$

where

Q is $$=\overset{|}{C}—Y$$

or =N—,

Y is hydrogen, halogen, cyano, $C_1$-$C_5$alkyl or $C_1$-$C_5$alkylsulfonyl,

V and W, independently of each other, are each $R_2$—$X_2$—, $R_3$—$X_3$—, hydroxyl $C_1$—$C_5$alkoxy or an unsubstituted or $C_1$—$C_5$alkyl— or $C_5$—$C_6$cycloalkyl-monosubstituted or —disubstituted amino group, the alkyl radical being unsubstituted or substituted by hydroxyl, cyano, sulfo or sulfato, $R_1$, $R_2$ and $R_3$, independently of one another, are each an aromatic or heteroaromatic radical, $X_1$, $X_2$ and $X_3$, independently of one another, are each —O—, —S—, $$—\underset{\underset{R_4}{|}}{N}—,$$

—NH—CO—Phen—NH— or NH—CO—Phen—CO—NH—, $R_4$ is hydrogen, $C_1$—$C_5$alkyl, $C_5$—$C_6$cycloalkyl or phenyl, Phen is an unsubstituted or substituted phenylene group, A is a direct bond, —CO— or —CONH—, Z is an acidic, water-solubilizing group and m is 1 to 6.

12 Claims, No Drawings

DYEING CELLULOSE FIBRES WITHOUT INCURRING ENDING WITH COLORLESS PYRIMIDINE, TRIAZINE, AROMATIC, FURFURYL OR QUINOLINYL COMPOUND

The present invention relates to a novel process for dyeing textile cellulose fibres with vat dyes, sulfur dyes, leuco vat ester dyes or azoic dyes by pad dyeing without incurring ending.

Pad dyeing is a dyeing process known for cellulose fibres which, by saturating or impregnating the fibre with the dye solution in a trough at a very short liquor ratio and usually with only one passage of the textile material through the pad-mangle, makes it possible to dye, and subsequently to fix, high yardages of textile fibre materials in a short dyeing time.

A known disadvantage of this kind of process is that in many cases the dyed fibre materials (lots) can be observed to exhibit ending.

Ending, or tailing/reverse tailing, refers to differences in the depth of shade and hue between the start and the end of a lot. If only one dye is used, ending becomes apparent in differences in the depth of a shade, while in combination shade dyeings shifts in the hue may frequently occur in addition.

Tailing refers to a weakening in the depth of shade between the start and the end of a lot, owing to a decrease in the concentration of dye in the trough. This impoverishment of the dye in the liquor is due to absorption of the dye during padding. Differences in the depth of shade and hue resulting from tailing occur in particular in the case of dyes of medium to high substantivity and, especially frequently, in the dyeing of light shades.

Reverse tailing refers to an increase in the depth of shade between the start and the end of a lot, owing to an increase in the concentration of dye in the trough. This increase in the concentration of dye in the padding liquor is due to preferential adsorption of water during padding. Differences in the depth of shade and hue resulting from reverse tailing occur with dyes of low substantivity, in particular when dyeing to dark shades.

Based on studies of ending (Journal of the Society of Dyers and Colourists 71 (1955), 13-20; SVF[Swiss Association of Dyeing Experts]-Fachorgan 16 (1961), 341-351; and ITS Veredlung 33 (1987/1), 5-6, 9, 12, 16, 19), prior art measures to remedy this disadvantageous effect, for example, shortening the immersion time, specific dye selection and adapting the concentration of the dye in the continuously replenished padding liquor to the affinity of the dye for the particular fibre or to the dyeing process, have failed to become established in practice. For instance, too short an immersion time is disadvantageous for heavyweight, closely woven and/or insufficiently hydrophilic and slow-swelling cloth; the use of a few selected dyes affords fewer options for shade matching and limits the use of such dyes to light or dark shades only; and varying the concentration of dye in the replenishing liquor is frequently too complicated in practice, inter alia on account of insufficient reproducibility.

There is consequently a long-felt need for dyeing without incurring ending.

Surprisingly, there has now been found a novel process which does not have the disadvantages mentioned and which makes it possible to dye textile cellulose fibres in a simple manner with vat dyes, sulfur dyes, leuko vat ester dyes or azoic dyes, in particular to light shades, by the pad dyeing process without incurring ending.

The present invention accordingly provides a process for dyeing cellulose fibres or cellulose-containing blend fibres with vat dyes, sulfur dyes, leuco vat ester dyes or azoic dyes by the pad dyeing process without incurring ending, which comprises using an aqueous dyeing liquor which, aside from the dye, contains a colourless nitrogen-containing compound of the formula

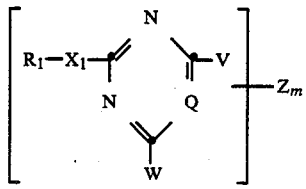

(1)

or of the formula $$[R_1—NH—A—R_2]—Z_m \quad (2)$$

where

Q is $$=\overset{|}{C}—Y$$

or in particular =N—,

Y is hydrogen, halogen, cyano, $C_1$-$C_5$alkyl or $C_1$-$C_5$alkylsulfonyl,

V and W, independently of each other, are each $R_2$—$X_2$—, $R_3$—$X_3$—, hydroxyl, $C_1$-$C_5$alkoxy or an unsubstituted or $C_1$-$C_5$alkyl— or $C_5$-$C_6$cycloalkyl-monosubstituted or -disubstituted amino group, the alkyl radical being unsubstituted or substituted by hydroxyl, cyano, sulfo (—$SO_3H$) or sulfato (—$OSO_3H$), $R_1$, $R_2$ and $R_3$, independently of one another, are each an aromatic or heteroaromatic radical, $X_1$, $X_2$ and $X_3$, independently of one another, are each —O—, —S—, $$—\underset{\underset{R_4}{|}}{N}—,$$

or —NH—CO—Phen—NH— or NH—CO—Phen—CO—NH—, $R_4$ is hydrogen, $C_1$-$C_5$alkyl, $C_5$-$C_6$cycloalkyl or phenyl, Phen is an unsubstituted or substituted phenylene group, A is a direct bond, —CO— or —CONH—, Z is an acidic, water-solubilizing group and m is 1 to 6.

The azine compounds of the formula (1) are preferred.

The colourless nitrogen-containing compound of the formula (1) or (2) used in the process according to the invention is water-soluble and has substantivity, i.e. affinity, for cellulose fibres.

The amount of compound with affinity for cellulose fibres in the process according to the invention depends in particular on the amount of dye used, a minimum of 0.5 g/l and in general of from 0.5 to 20 g/l, preferably of from 3 g/l to 10 g/l, having proved very advantageous.

The compound with affinity for cellulose fibres contains 1 to 6, advantageously 1 to 4, acidic water-solubilizing groups comprising in particular carboxyl groups or especially sulfonic acid groups. The compound with affinity for cellulose fibres may in this connection contain not only carboxyl groups or sulfo groups only but also both carboxyl and sulfo groups. Preferably, the compound with affinity for cellulose fibres contains from 2 to 4 sulfonic acid groups.

$C_1$–$C_5$alkyl denotes alkyl radicals or moieties which contain from 1 to 5 carbon atoms and may be straight-chain or branched. Examples are methyl, ethyl, n-propyl, isopropyl, n-butyl, sec-butyl, isobutyl, tert-butyl, n-amyl and isoamyl. Examples of $C_1$–$C_5$alkoxy are methoxy, ethoxy, isopropoxy, sec-butoxy, tert-butoxy and tert-amyloxy.

Aromatic or heteroaromatic radicals $R_1$, $R_2$ and $R_3$ are foe example phenyl, biphenylyl, naphthyl, stilbenyl, furfuryl or quinolinyl. Phenyl and naphthyl are preferred. Preferred substituents on these radicals besides Z are halogens and hydroxyl.

Halogen is for example fluorine, bromine or preferably chlorine.

Possible substituents on the phen group are hydroxyl, cyano, nitro, halogen, $C_1$–$C_5$alkyl, trifluoromethyl, $C_1$–$C_5$alkoxy, $C_2$–$C_5$alkoxycarbonyl, amino, mono- or di-$C_1$–$C_5$alkylamino, phenylamino, carbamoyl, sulfamoyl, ureido, $C_1$–$C_7$acylamino, e.g. acetylamino, propionylamino or benzoylamino, $C_1$–$C_5$alkylsulfonyl, e.g. methylsulfonyl, or sulfomethyl or sulfatoethyl.

The colourless nitrogen-containing compounds used in the process according to the invention are known per se or can be prepared by a method known per se. They are present either in the form of free acid or preferably as salts thereof. Suitable salts are for example the alkali metal, alkaline earth metal or ammonium salts and the salts of an organic amine. Examples are the sodium, potassium and ammonium salts and the salt of triethylamine or triethanolamine.

In the azine compounds of the formula (1), V is preferably $R_2$—$X_2$— and W is in particular $R_3$—$X_3$—. Particular preference is given to azine compounds of the formula (1) where $X_1$, $X_2$ and $X_3$ are each —NH—. Very particular preference is given to compounds of the formula (1) where $R_1$, $R_2$ and $R_3$ are each an aryl radical, for example a naphthyl or in particular a phenyl radical. Also of practical interest are azine compounds of the formula (1) where V is $R_2$—$X_2$— and W is hydroxyl.

Of the large number of possible water-soluble azine compounds with affinity for cellulose fibres, suitable types of compounds are for example those of the following formulae:

(3)

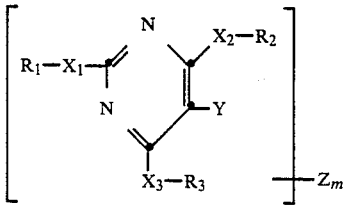

-continued (4)

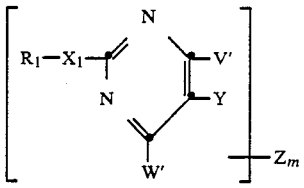

(5)

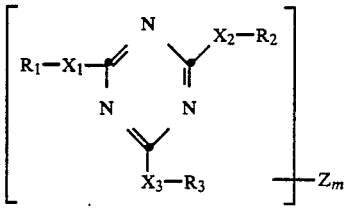

(6)

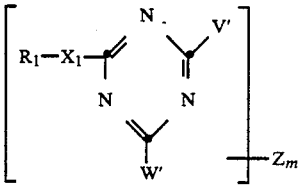

where Y is as defined above, in particular hydrogen or halogen,

V′ and W′, independently of each other, are each hydroxyl, $C_1$–$C_4$alkoxy or an unsubstituted or $C_1$–$C_5$alkyl-monosubstituted or -disubstituted amino group, the alkyl radical being unsubstituted or substituted by hydroxyl, cyano, sulfo or sulfato, and V′ is also the radical $R_2$—$X_2$—, $R_1$, $R_2$ and $R_3$, independently of one another, are each an aromatic or heteroaromatic radical, e.g. phenyl, biphenylyl, naphthyl, stilbenyl, furfuryl or quinolinyl, and besides Z may contain any desired nonionic substituents, for example alkyl groups having 1 to 5 carbon atoms, such as methyl, ethyl, propyl, isopropyl, butyl or amyl, alkoxy groups having 1 to 4 carbon atoms, such as methoxy, ethoxy, propoxy, isopropoxy or butoxy, acylamino groups having 1 to 7 carbon atoms, for example acetylamino, propionylamino or benzoylamino, amino, mono- or dialkylamino having 1 to 5 carbon atoms in the alkyl radical, phenylamino, alkoxycarbonyl having 1 to 4 carbon atoms in the alkoxy radical, nitro, cyano, trifluoromethyl, halogen, e.g. fluorine, chlorine or bromine, sulfamoyl, carbamoyl, ureido, hydroxyl, $C_1$–$C_4$alkylsulfonyl, e.g. methylsulfonyl, or else sulfomethyl ($HO_3S$—$CH_2$—), $X_1$, $X_2$ and $X_3$, independently of one another, are each —O—, —S— or —N($R_5$)—, $R_5$ being hydrogen, $C_1$–$C_4$alkyl or phenyl, Z is an acidic, water-solubilizing group, for example a carboxyl or preferably sulfonic acid group, and m is 2, 3, 4, 5 or 6, preferably 2 to 4.

Of note are triazine compounds of the formula (5) where $X_1$, $X_2$ and $X_3$ are each —NH—, $R_1$, $R_2$ and $R_3$, independently of one another, are each phenyl or naphthyl, Z is a sulfonic acid group and m is 2 to 4, preferably 2 or 3. Also of practical interest are triazine compounds of the formula (6) where V′ is $R_2$—$X_2$— and W′ is hydroxyl.

Particularly interesting triazine compounds conform for example to the formulae (7)
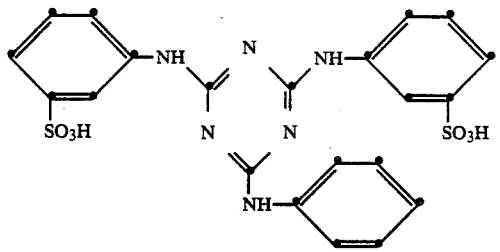
(8)
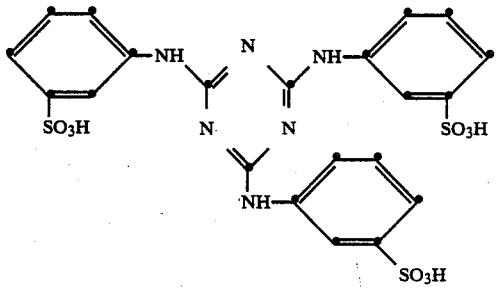
(9)
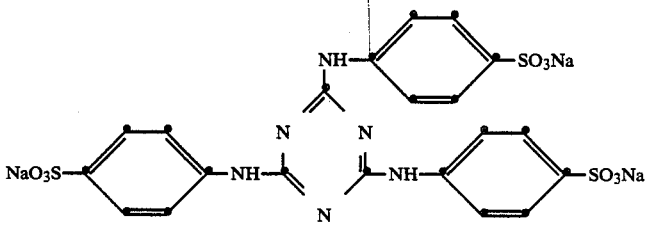
(10)
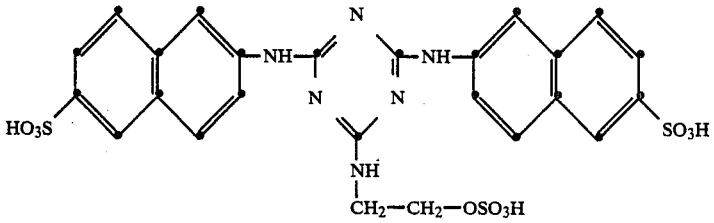
(11)
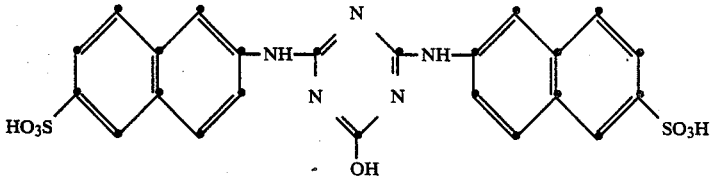
(12)
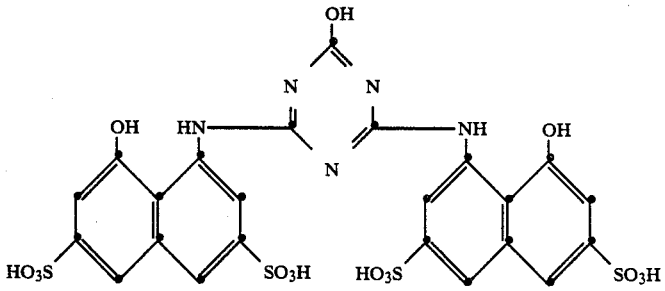

-continued
(13)
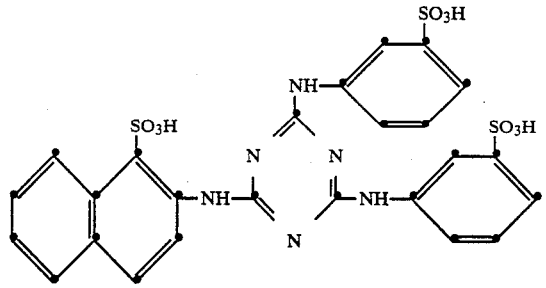
(14)
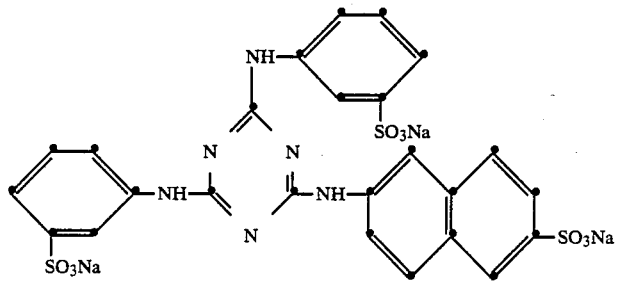
(15)
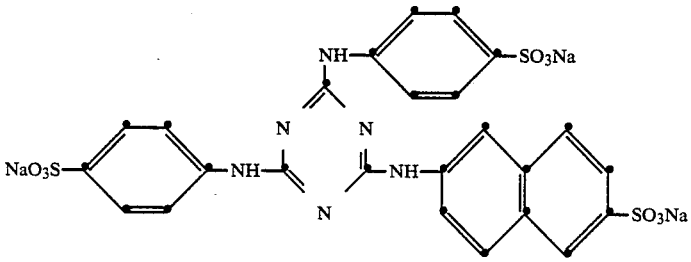
(16)
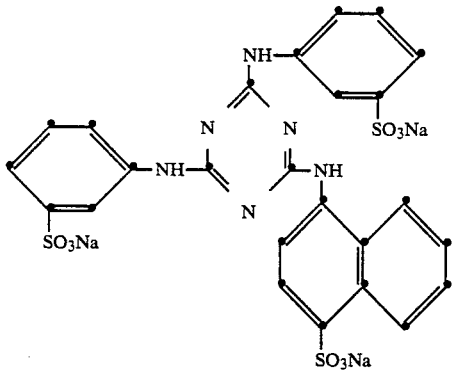
(17)
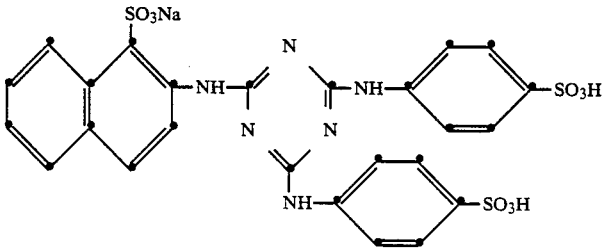
and -continued

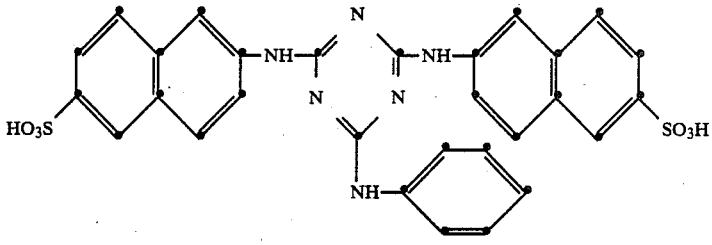

(18)

Further examples of colourless nitrogen-containing compounds usable according to the invention are

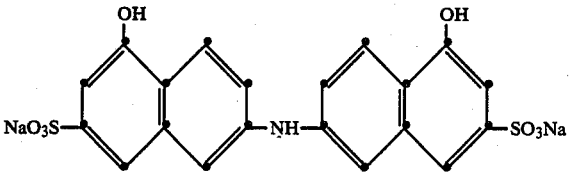

(19)

and

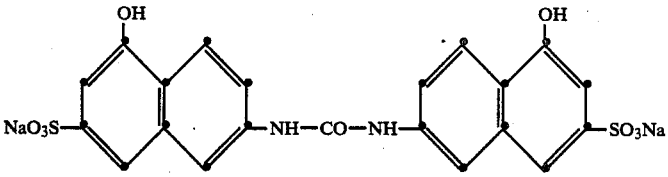

(20)

Suitable cellulose fibres are natural fibres, such as mercerized or bleached cotton and linen (bleached), and regenerated fibres, such as viscose filament, viscose staple, polynosics and cuprammonium rayon. It is in the main woven or knitted fabrics of these fibres, cotton in particular, which are used. It is also possible to use fibre blends, for example those of polyester/cotton, in which case the polyester portion is dyed with disperse dyes.

Dyes which are usable in the process according to the invention are the dyes of the defined type customarily used for dyeing or printing cellulose textile materials.

Leuco vat ester dyes are obtainable for example from vat dyes of the indigo, anthraquinone or indanthrene series by reduction, for example with iron powder, and subsequent esterification, for example with chlorosulfonic acid, and are referred to as "solubilised vat dyes" in the Colour Index 3rd Edition, 1971, Volume 3.

Vat dyes are for example higher fused and heterocyclic benzoquinones or naphthoquinones, in particular anthraquinonoid or indigoid dyes, especially sulfur dyes. Examples of vat dyes usable according to the invention are listed in the Colour Index 3rd Edition (1971) Volume 3 on pages 3649 to 3837 under "Sulphur Dyes" and "Vat Dyes".

Suitable components for azoic dyes are the chemical compounds listed in the Colour Index 3rd Edition 1971 as azoic coupling components ("naphthols") and as azoic diazo components.

The amount of dye in the process according to the invention depends in general on the desired depth of shade, bearing in mind that ending becomes noticeable in particular in the case of pale shades, i.e. at a concentration of 0.03 g/l to 10 g/l, preferably 0.05 to 6 g/l.

A particularly preferred embodiment of the process according to the invention comprises using an aqueous dyeing liquor containing 1 to 6 g/l of dye and 3 to 10 g/l of azine compound. The designation g/l denotes grams per liter. In the case of dyes it is based on the 100% commercial powder form.

The dyeing liquors, in addition to the colourless compound, may contain, depending on the dye to be used, further customary additives, for example alkali such as sodium carbonate, sodium bicarbonate, sodium hydroxide, potassium hydroxide, trisodium phosphate, borax, aqueous ammonia or alkali donors, for example sodium formate or sodium trichloroacetate, electrolytes, for example sodium chloride or sodium sulfate, and also urea, thiourea or glycerol. Optionally, it is also possible for thickening agents, for example alginates, starch ethers or carob bean flour ether, to be present therein.

The reducing agent used for converting the vat dyes into the form of the leuco compound, in which form they have affinity for the cellulose fibre, this step being called vatting, is for example sodium dithionite (sodium hydrosulfite). Vatting generally takes place in an alkaline medium.

It has frequently proved advantageous to add to the padding liquors in addition commercially available alkali-resistant wetting agents, for example sulfonates of polycarboxylic esters, e.g. dihexyl sulfosuccinates or dioctyl sulfosuccinates, alkylarylsulfonates having straight-chain or branched alkyl of at least 6 carbon atoms, e.g. dodecylbenzenesulfonates or preferably alkylsulfonates whose alkyl chain contains 8 to 20 carbon atoms, for example dodecylsulfonates or pentadecylsulfonates. The sulfonates mentioned as wetting agents are in general present as alkali metal salts, in particular as sodium salts, or else as ammonium salts.

The amounts in which the wetting agents are added to the dyeing liquor vary advantageously between 0.2 and 10 g, preferably between 0.5 and 3 g, per liter of liquor.

Dye fixation on pure cellulose fibres is effected by customary methods, where fixing time and fixing temperature are dependent on the fibre material and on the dye. To obtain uniform and optimal dye fixation, steaming in saturated steam for between 30 seconds and 5 minutes at 100° to 105° C. is in general sufficient. High-temperature steaming and dry-heat steaming gave fixation in the course of 20 seconds to 3 minutes at 105°-190° C. In particular, the dyes are fixed with steam at a temperature of 100° C. to 120° C. in the course of 30 seconds to 3 minutes. If desired, the textile material is dried before fixing.

Furthermore, fixing can also be effected by the cold pad-batch method, for example in the course of 6 to 24 hours at room temperature.

Following the dyeing process, the dyed cellulose material can be washed in a conventional manner to remove unfixed dye. To this end the substrate is treated for example at 40° C. to the boil in a solution which contains soap or synthetic detergent. This can be followed by a treatment with a fixing agent to improve the wet fastness properties.

The dyeings are finished by rinsing in hot and/or cold water and if desired subsequent washing in the presence of a commercially available detergent, followed by rinsing in water and drying.

The Examples which follow serve to illustrate the invention. Parts and percentages are by weight. The temperatures are given in degrees Celsius.

EXAMPLE 1

A bleached cotton cord fabric is impregnated on a pad-mangle to a 90% wet pick-up with an aqueous liquor containing per liter 6 g of the dye Leuco Sulfur Red 1 C.I. 53721,
5 g of sodium sulfide,
1 ml of 36° Bé sodium hydroxide solution,
1 g of wetting agent and
8 g of a triazine compound of the formula (8).

The immersion time is 3 seconds. After padding the fabric is steamed at 101°-103° C. for one minute and rinsed at 25° C. with water. The dyeing is then oxidized with 5 ml of hydrogen peroxide at 70° C. for 2 minutes, subsequently soaped and rinsed hot and cold.

The result obtained is a cotton cord fabric dyed in a red shade without incurring ending which has very good fastness properties.

COMPARATIVE EXAMPLE 1

Example 1 is repeated, except that a liquor without the triazine compound of the formula (8) is used. The result obtained is a cotton cord fabric dyed in a red shade which shows tailing, the start of the lot being dyed deeper compared with the end of the lot, because the squeezed-off liquor depletes in dye and thus becomes dilute.

EXAMPLE 2

3 g/l of the dye of the formula

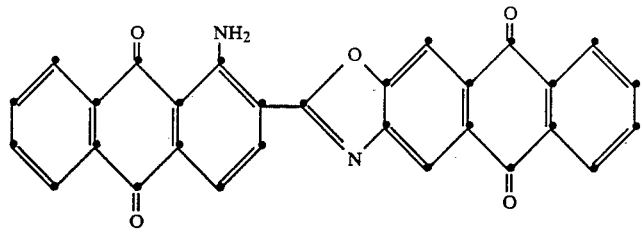

are vatted at 50° C. with an aqueous formulation containing 25 ml/l of 36° Bé sodium hydroxide solution and
20 g/l of sodium hydrosulfite in the course of 15 minutes. After cooling to 25° C., 7 g/l of the triazine compound of formula (13) are added to the vatted formulation. This formulation can be used to impregnate a bleached mercerized cotton cretonne fabric on a pad-mangle to a wet pick-up of 70%. The immersion time is 2 seconds.

After impregnating, the dyeing is treated at 101° C. with saturated steam for 90 seconds and rinsed cold, and the dyeing is then oxidized at 70° C. with 7 ml/l of hydrogen peroxide in the course of 60 seconds, soaped off at the boil with 1 g/l of detergent, rinsed hot and cold and dried.

The result obtained is a cotton fabric dyed without incurring ending in a red shade which has very good fastness properties.

EXAMPLE 3

A bleached mercerized cotton poplin fabric is impregnated on a pad-mangle to a wet pick-up of 75% with an aqueous liquor containing per liter.

1.5 g of the dye Solubilised Vat Blue 6 C.I. 69826,
8 g of the triazine compound of the formula (9),
1 g of wetting agent and
6 g of sodium nitrite.

The immersion time is 2.5 seconds. After impregnating, the fabric is dried at 100° C. for one minute. The dyed material is then treated with an aqueous solution containing per liter 20 ml of 66° Bé sulfuric acid,
2 g of a dispersant, for example a mixture of fatty acid/protein condensation product with alkylphenol polyglycol ether, and
1 g of thiourea.

After an air passage of 20 seconds the fabric is rinsed cold, neutralized with an aqueous solution containing 2 g/l of sodium carbonate, soaped off at the boil, rinsed hot and cold and finally dried.

The result obtained gave a cotton fabric dyed without incurring ending in a blue shade having very good fastness properties.

EXAMPLE 4

A causticized cotton cretonne fabric is impregnated at 50° C. on a pad-mangle to a wet pick-up of 80% with an aqueous formulation containing per liter 4 g of Azoic Coupling Component 20 of C.I. No. 37530,
4 ml of 30% sodium hydroxide solution and
4 g of the azine compound of the formula (12).

The immersion time is 3 seconds.

Following an air passage of 30 seconds the cotton cretonne fabric is dried in a hot flue at 120° C. for 45 seconds. The colour is then developed by impregnating on a pad-mangle to a wet pick-up of 80% with an aqueous liquor containing 13 g/l of Azoic Diazo Component 1 of C.I. No. 37135. The immersion time is 6 seconds. Passage through the developing pad-mangle is followed by an air passage of 30 seconds. The cotton cretonne fabric is then rinsed with water at 70° C., soaped off at the boil with 2 g/l of detergent, rinsed hot and cold and dried.

The result obtained is a cotton cretonne fabric dyed without incurring ending in a red shade having good fastness properties.

EXAMPLES 5

A 50/50 polyester-cotton blend fabric is impregnated on a pad-mangle to a wet pick-up of 65% with an aqueous liquor containing per liter 1.5 g of the dye Solubilised Vat Red 1 C.I. 73361, 8 g of the colourless compound of the formula (20), 1 g of a customary wetting agent, for example dodecylbenzenesulfonic acid, and 6 g of sodium nitrite.

The immersion time is 2.5 seconds. After impregnating, the fabric is dried at 100° C. for 60 seconds. The dyed fabric is then treated with an aqueous liquor containing per liter 20 ml of 66° Bé sulfuric acid, 2 g of a customary dispersant, for example a mixture of fatty acid/protein condensation product with alkylphenol polyglycol ether, and 1 g of thiourea.

After an air passage of 20 seconds the fabric is rinsed cold, neutralized with an aqueous solution containing 2 g/l of sodium carbonate, soaped off at the boil, rinsed hot and cold and finally dried.

The result obtained is a cotton portion dyed without incurring ending in a pink shade having very good fastness properties.

What is claimed is:

1. A process for dyeing cellulose fibres or cellulose-containing blend fibres with vat dyes, sulfur dyes, leuco vat ester dyes or azoic dyes by the pad dyeing process without incurring ending, which process comprises treating said fibres with an aqueous dyeing liquor, which, aside from the dye, contains a colourless compound of the formula

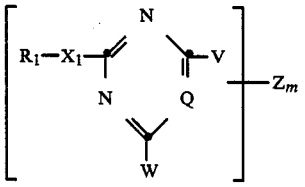

(1)

or of the formula $$[R_1—NH—A—R_2]—Z_m \quad (2)$$

where

Q is $$=\overset{|}{C}—Y$$

or =N—,

Y is hydrogen, halogen, cyano, $C_1$-$C_5$alkyl or $C_1$-$C_5$alkylsulfonyl,

V and W, independently of each other, are each $R_2$—$X_2$—, $R_3$—$X_3$—, hydroxyl, $C_1$-$C_5$alkoxy or an unsubstituted or $C_1$-$C_5$alkyl- or $C_5$-$C_6$cycloalkyl-monosubstituted or -disubstituted amino group, the alkyl radical being unsubstituted or substituted by hydroxyl, cyano, sulfo or sulfato, $R_1$, $R_2$ and $R_3$, independently of one another, are each an aromatic, furfuryl or quinolinyl radical, $X_1$, $X_2$ and $X_3$, independently of one another, are each —O—, —S—, $$—\underset{\underset{R_4}{|}}{N}—,$$

—NH—CO—Phen—NH— or NH—CO—Phen—CO—NH—, $R_4$ is hydrogen, $C_1$-$C_5$alkyl, $C_5$-$C_6$cycloalkyl or phenyl, Phen is an unsubstituted or substituted phenylene group, A is a direct bond, —CO— or —CONH—, Z is an acidic, water-solubilizing group and m is 1 to 6.

2. A process according to claim 1, wherein in the azine compound of formula (1) Q is —N=.

3. A process according to claim 1, wherein in the azine compound of formula (1) V is $R_2$—$X_2$— and W is $R_3$—$R_3$—.

4. A process according to claim 1, wherein in the azine compound of formula (1) $X_1$, $X_2$ and $X_3$ are each —NH—.

5. A process according to claim 1, wherein in the azine compound of formula (1) $R_1$, $R_2$ and $R_3$ are each aryl.

6. A process according to claim 1, wherein in the azine compound of formula (1) m is 2 to 4.

7. A process according to claim 1, wherein in the azine compound of formula (1) Z is a sulfonic acid group.

8. A process according to claim 1, wherein use is made of an azine compound of the following formulae:

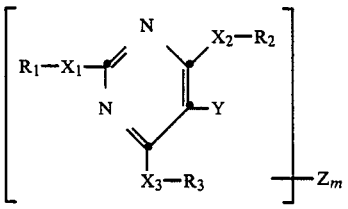

(3)

-continued (4)

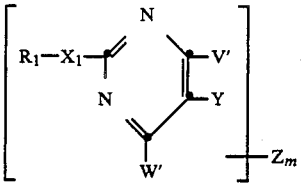

(5)

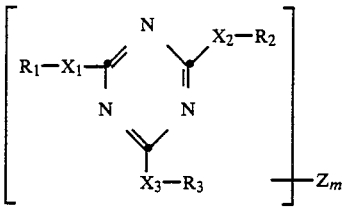

-continued (6)

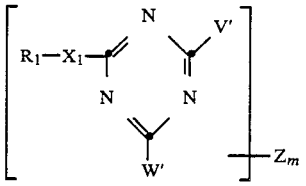

where Y is hydrogen or halogen, V' and W', independently of each other, are each hydroxyl, $C_1$-$C_4$alkoxy or an unsubstituted or $C_1$-$C_5$-alkyl-monosubstituted or -disubstituted amino group, the alkyl radical being unsubstituted or substituted by hydroxyl, cyano, sulfo or sulfato, and V' is also the radical $R_2$—$X_2$—, $R_1$, $R_2$ and $R_3$, independently of one another, are each an aromatic or heteroaromatic radical, $X_1$, $X_2$ and $X_3$, independently of one another, are each —O—, —S— or —N($R_5$)—, $R_5$ being hydrogen, $C_{1-4}$alkyl or phenyl, Z is an acidic, water-solubilizing group and m is 2 to 6.

9. A process according to claim 8, wherein in the triazine compound of formula (5) $X_1$, $X_2$ and $X_3$ are each —NH—, $R_1$, $R_2$ and $R_3$, independently of one another, are each phenyl or naphthyl, Z is sulfonic acid group and m is 2 to 4.

10. A process according to claim 8, wherein in the triazine compound of formula (6) V' is $R_2$—$X_2$— and W' is hydroxyl.

11. A process according to claim 1, wherein cellulose fibres are dyed.

12. A process according to claim 1, wherein cellulose fibres are dyed with sulfur dyes and the dyeing is finished with steam at a temperature of 100° to 120° C.

* * * * *